US007505563B2

(12) United States Patent
Morton et al.

(10) Patent No.: US 7,505,563 B2
(45) Date of Patent: Mar. 17, 2009

(54) X-RAY SOURCES

(75) Inventors: Edward James Morton, Guildford (GB); Russell David Luggar, Dorking (GB); Paul De Antonis, Horsham (GB)

(73) Assignee: Rapiscan Systems, Inc., Hawthorne, CA (US)

( * ) Notice: Subject to any disclaimer, the term of this patent is extended or adjusted under 35 U.S.C. 154(b) by 0 days.

(21) Appl. No.: 12/033,035

(22) Filed: Feb. 19, 2008

(65) Prior Publication Data

US 2008/0267355 A1 Oct. 30, 2008

Related U.S. Application Data

(63) Continuation of application No. 10/554,569, filed as application No. PCT/GB2004/001732 on Apr. 23, 2004, now Pat. No. 7,349,525.

(30) Foreign Application Priority Data

Apr. 25, 2003 (GB) ..... 0309374.7

(51) Int. Cl.
*H01J 35/08* (2006.01)

(52) U.S. Cl. ..... 378/124; 378/143

(58) Field of Classification Search ..... 378/124, 378/119, 147, 149, 137, 138
See application file for complete search history.

(56) References Cited

U.S. PATENT DOCUMENTS

| | | | |
|---|---|---|---|
| 2,952,790 | A | 9/1960 | Steen |
| 3,239,706 | A | 3/1966 | Farrell et al. |
| 4,057,725 | A | 11/1977 | Wagner |
| 4,228,353 | A | 10/1980 | Johnson |
| 4,266,425 | A | 5/1981 | Allport |
| 4,274,005 | A | 6/1981 | Yamamura et al. |
| 4,340,816 | A | 7/1982 | Schott |
| 4,468,802 | A | 8/1984 | Friedel |
| 4,672,649 | A | 6/1987 | Rutt |
| 4,675,890 | A | 6/1987 | Plessis et al. |
| RE32,961 | E | 6/1989 | Wagner |
| 4,866,745 | A | 9/1989 | Akai |
| 4,868,856 | A | 9/1989 | Frith et al. |
| 4,887,604 | A | 12/1989 | Shefer et al. |
| 5,247,556 | A | 9/1993 | Eckert et al. |
| 5,259,014 | A | 11/1993 | Brettschneider |
| 5,511,104 | A | 4/1996 | Mueller et al. |
| 5,604,778 | A | 2/1997 | Polacin et al. |
| 5,633,907 | A | 5/1997 | Gravelle et al. |
| 5,689,541 | A | 11/1997 | Schardt |
| 5,841,831 | A | 11/1998 | Hell et al. |

(Continued)

FOREIGN PATENT DOCUMENTS

| | | |
|---|---|---|
| DE | 2729353 | 1/1979 |

(Continued)

*Primary Examiner*—Hoon Song
(74) *Attorney, Agent, or Firm*—Patentmetrix

(57) ABSTRACT

An anode for an X-ray source is formed in two parts, a main part and a collimating part. The main part has the target region formed on it. The two parts between them define an electron aperture through which electrons pass to reach the target region, and an X-ray aperture through which the X-rays produced at the target leave the anode. The anode produces at least the first stage of collimation of the X-ray beam produced.

13 Claims, 2 Drawing Sheets

U.S. PATENT DOCUMENTS

| | | | | |
|---|---|---|---|---|
| 5,966,422 | A | 10/1999 | Dafni et al. | |
| 5,987,097 | A | 11/1999 | Salasoo | |
| 6,181,765 | B1 | 1/2001 | Sribar et al. | |
| 6,975,703 | B2 * | 12/2005 | Wilson et al. | 378/124 |
| 6,993,115 | B2 * | 1/2006 | McGuire et al. | 378/124 |
| 2002/0094064 | A1 | 7/2002 | Zhou et al. | |

FOREIGN PATENT DOCUMENTS

| | | |
|---|---|---|
| EP | 0 432 568 | 6/1991 |
| EP | 0 531 993 | 3/1993 |
| EP | 0 584 871 | 3/1994 |
| EP | 0 924 742 | 6/1999 |
| EP | 0 930 046 | 7/1999 |
| EP | 1 277 439 | 1/2003 |
| EP | 1558142 | 8/2005 |
| FR | 2328280 | 5/1977 |
| GB | 1497396 | 1/1978 |
| GB | 1526041 | 9/1978 |
| GB | 2 015 245 | 9/1979 |
| GB | 2089109 | 6/1982 |
| GB | 2 212 903 | 8/1989 |
| JP | 570175247 | 10/1982 |
| JP | 590016254 | 1/1984 |
| JP | 59075549 | 4/1984 |
| JP | 60 0015546 | 1/1985 |
| JP | 60 0021440 | 2/1985 |
| JP | 04 079128 | 3/1992 |
| JP | 060038957 | 2/1994 |
| JP | 10 211196 | 8/1998 |
| JP | 2001 176408 | 6/2001 |
| SU | 1 022 236 | 6/1983 |
| WO | WO 95/28715 | 10/1995 |
| WO | WO 99/60387 | 11/1999 |
| WO | WO 03/051201 | 6/2003 |

* cited by examiner

X-RAY SOURCES

CROSS-REFERENCE

The present application is a continuation of U.S. patent application Ser. No. 10/554,569, filed on Oct. 25, 2005, which is a national stage application of PCT/GB2004/001732, filed on Apr. 23, 2004 and which, in turn, relies on Great Britain Application Number 0309374.7, filed on Apr. 25, 2003, for priority.

FIELD OF THE INVENTION

The present invention relates to X-ray sources and in particular to the design of anodes for X-ray sources.

BACKGROUND OF THE INVENTION

Multifocus X-ray sources generally comprise a single anode, typically in a linear or arcuate geometry, that may be irradiated at discrete points along its length by high energy electron beams from a multi-element electron source. Such multifocus X-ray sources can be used in tomographic imaging systems or projection X-ray imaging systems where it is necessary to move the X-ray beam.

SUMMARY OF THE INVENTION

The present invention provides an anode for an X-ray tube comprising a target arranged to produce X-rays when electrons are incident upon it, the anode defining an X-ray aperture through which the X-rays from the target are arranged to pass thereby to be at least partially collimated by the anode.

The anode may be formed in two parts, and the X-ray aperture can conveniently be defined between the two parts. This enables simple manufacture of the anode. The two parts are preferably arranged to be held at a common electrical potential.

Preferably a plurality of target regions are defined whereby X-rays can be produced independently from each of the target regions by causing electrons to be incident upon it. This makes the anode suitable for use, for example, in X-ray tomography scanning. In this case the X-ray aperture may be one of a plurality of X-ray apertures, each arranged so that X-rays from a respective one of the target regions can pass through it.

Preferably the anode further defines an electron aperture through which electrons can pass to reach the target. Indeed the present invention further provides an anode for an X-ray tube comprising a target arranged to produce X-rays when electrons are incident upon it, the anode defining an electron aperture through which electrons can pass to reach the target.

Preferably the parts of the anode defining the electron aperture are arranged to be at substantially equal electrical potential. This can result in zero electric field within the electron aperture so that electrons are not deflected by transverse forces as they pass through the electron aperture. Preferably the anode is shaped such that there is substantially zero electric field component perpendicular to the direction of travel of the electrons as they approach the anode. In some embodiments the anode has a surface which faces in the direction of incoming electrons and in which the electron aperture is formed, and said surface is arranged to be perpendicular to the said direction.

Preferably the electron aperture has sides which are arranged to be substantially parallel to the direction of travel of electrons approaching the anode. Preferably the electron aperture defines an electron beam direction in which an electron beam can travel to reach the target, and the target has a target surface arranged to be impacted by electrons in the beam, and the electron beam direction is at an angle of 10° or less, more preferably 5° or less, to the target surface.

Preferably the anode claim further comprises cooling means arranged to cool the anode. For example the cooling means may comprise a coolant conduit arranged to carry coolant through the anode. Preferably the anode comprises two parts and the coolant conduit is provided in a channel defined between the two parts.

The present invention further provides an X-ray tube including an anode according to the invention.

BRIEF DESCRIPTION OF THE DRAWINGS

Preferred embodiments of the present invention will now be described by way of example only with reference to the accompanying drawings in which.

DETAILED DESCRIPTION OF THE INVENTION

Figure 1:
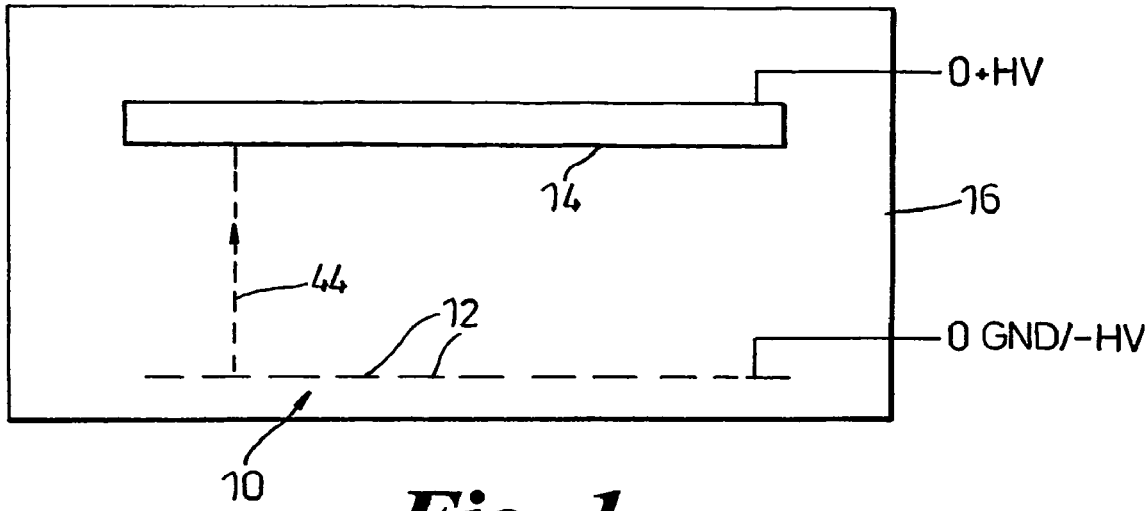
FIG. 1 is a schematic representation of an X-ray tube according to a first embodiment of the invention.

Referring to FIG. 1, an X-ray tube according to the invention comprises a multi-element electron source 10 comprising a number of elements 12 each arranged to produce a respective beam of electrons, and a linear anode 14, both enclosed in a tube envelope 16. The electron source elements 12 are held at a high voltage negative electrical potential with respect to the anode.

Figure 2:
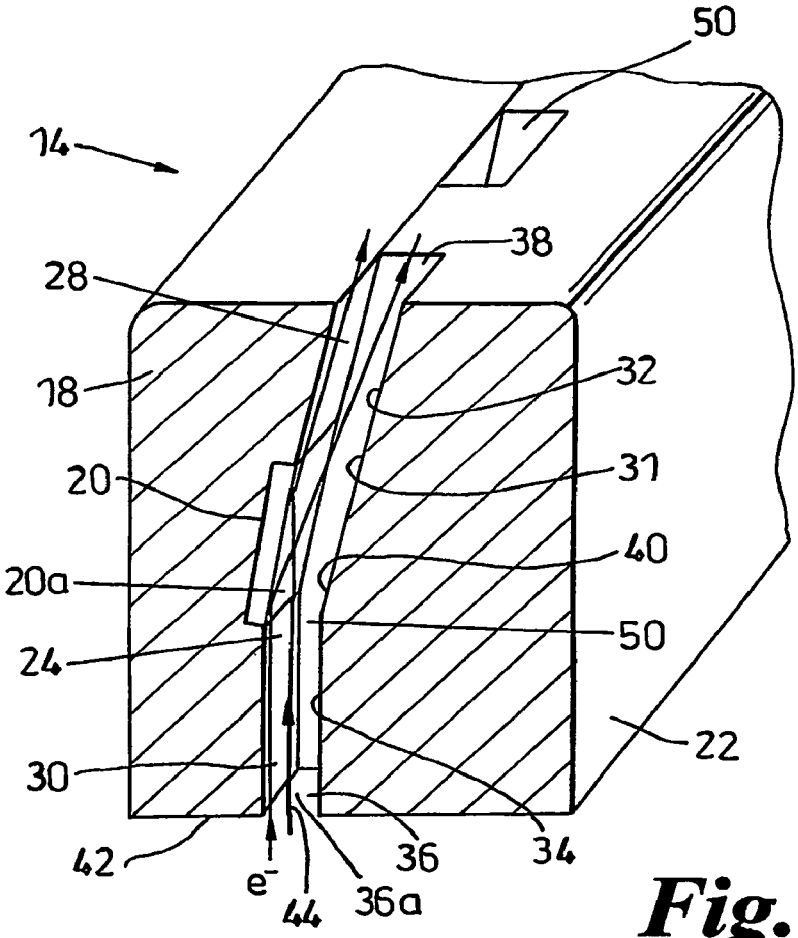
FIG. 2 is a partial perspective view of an anode according to a second embodiment of the invention.

Referring to FIG. 2, the anode 14 is formed in two parts: a main part 18 which has a target region 20 formed on it, and a collimating part 22, both of which are held at the same positive potential, being electrically connected together. The main part 18 comprises an elongate block having an inner side 24 which is generally concave and made up of the target region 20, an X-ray collimating surface 28, and an electron aperture surface 30. The collimating part 22 extends parallel to the main part 18. The collimating part 22 of the anode is shaped so that its inner side 31 fits against the inner side 24 of the main part 18, and has a series of parallel channels 50 formed in it such that, when the two parts 18, 22 of the anode are placed in contact with each other, they define respective electron apertures 36 and X-ray apertures 38. Each electron aperture 36 extends from the surface 42 of the anode 14 facing the electron source to the target 20, and each X-ray aperture extends from the target 20 to the surface 43 of the anode 14 facing in the direction in which the X-ray beams are to be directed. A region 20*a* of the target surface 20 is exposed to electrons entering the anode 14 through each of the electron apertures 36, and those regions 20*a* are treated to form a number of discrete targets.

In this embodiment, the provision of a number of separate apertures through the anode 14, each of which can be aligned with a respective electron source element, allows good control of the X-ray beam produced from each of the target regions 20*a*. This is because the anode can provide collimation of the X-ray beam in two perpendicular directions. The target region 20 is aligned with the electron aperture 36 so that electrons passing along the electron aperture 36 will impact the target region 20. The two X-ray collimating surfaces 28, 32 are angled slightly to each other so that they define between them an X-ray aperture 38 which widens slightly in the direction of travel of the X-rays away from the target region 20. The target region 20, which lies between the electron aperture surface 30 and the X-ray collimating surface 28 on the main anode part 18 is therefore opposite the region 40 of the collimating part 22 where its electron aperture surface 34 and X-ray collimating surface 32 meet.

Adjacent the outer end 36*a* of the electron aperture 36, the surface 42 of the anode 14 which faces the incoming electrons and is made up on one side of the electron aperture 36 by the main part 18 and on the other side by the collimating part 22, is substantially flat and perpendicular to the electron aperture surfaces 30, 34 and the direction of travel of the incoming electrons. This means that the electrical field in the path of the electrons between the source elements 12 and the target 20 is parallel to the direction of travel of the electrons between the source elements 12 and the surface 42 of the anode facing the source elements 12. Then within the electron aperture 36 between the two parts 18, 22 of the anode 14 there is substantially no electric field, the electric potential in that space being substantially constant and equal to the anode potential.

In use, each of the source elements 12 is activated in turn to project a beam 44 of electrons at a respective area of the target region 20. The use of successive source elements 12 and successive areas of the target region enables the position of the X-ray source to be scanned along the anode 14 in the longitudinal direction perpendicular to the direction of the incoming electron beams and the X-ray beams. As the electrons move in the region between the source 12 and the anode 14 they are accelerated in a straight line by the electric field which is substantially straight and parallel to the required direction of travel of the electrons. Then, when the electrons enter the electron aperture 36 they enter the region of zero electric field which includes the whole of the path of the electrons inside the anode 14 up to their point if impact with the target 20. Therefore throughout the length of their path there is substantially no time at which they are subject to an electric field with a component perpendicular to their direction of travel. The only exception to this is any fields which are provided to focus the electron beam. The advantage of this is that the path of the electrons as they approach the target 20 is substantially straight, and is unaffected by, for example, the potentials of the anode 14 and source 12, and the angle of the target 20 to the electron trajectory.

When the electron beam 44 hits the target 20 some of the electrons produce fluorescent radiation at X-ray energies. This X-ray radiation is radiated from the target 20 over a broad range of angles. However the anode 14, being made of a metallic material, provides a high attenuation of X-rays, so that only those leaving the target in the direction of the collimating aperture 38 avoid being absorbed within the anode 14. The anode therefore produces a collimated beam of X-rays, the shape of which is defined by the shape of the collimating aperture 38. Further collimation of the X-ray beam may also be provided, in conventional manner, externally of the anode 14.

Some of the electrons in the beam 44 are backscattered from the target 20. Backscattered electrons normally travel to the tube envelope where they can create localised heating of the tube envelope or build up surface charge that can lead to tube discharge. Both of these effects can lead to reduction in lifetime of the tube. In this embodiment, electrons backscattered from the target 20 are likely to interact with the collimating part 22 of the anode 14, or possibly the main part 18. In this case, the energetic electrons are absorbed back into the anode 14 so avoiding excess heating, or surface charging, of the tube envelope 16. These backscattered electrons typically have a lower energy than the incident (full energy) electrons and are therefore more likely to result in lower energy bremsstrahlung radiation than fluorescence radiation. There is a high chance that this extra off-focal radiation will be absorbed within the anode 14 and therefore there is little impact of off-focal radiation from this anode design.

In this particular embodiment shown in FIG. 2, the target 20 is at a low angle of preferably less than 10°, and in this case about 5°, to the direction of the incoming electron beam 44, so that the electrons hit the target 20 at a glancing angle. The X-ray aperture 38 is therefore also at a low angle, in this case about 10° to the electron aperture 36. With conventional anodes, it is particularly in this type of target geometry that the incoming electrons tend to be deflected by the electric field from the target before hitting it, due to the high component of the electric field in the direction transverse to the direction of travel of the electrons. This makes glancing angle incidence of the electrons on the anode very difficult to achieve. However, in this embodiment the regions inside the electron aperture 36 and the X-ray aperture 38 are at substantially constant potential and therefore have substantially zero electric field. Therefore the electrons travel in a straight line until they impact on the target 20. This simplifies the design of the anode, and makes the glancing angle impact of the electrons on the anode 20 a practical design option. One of the advantages of the glancing angle geometry is that a relatively large area of the target 20, much wider than the incident electron beam, is used. This spreads the heat load in the target 20 which can improve the efficiency and lifetime of the target.

Figure 3:
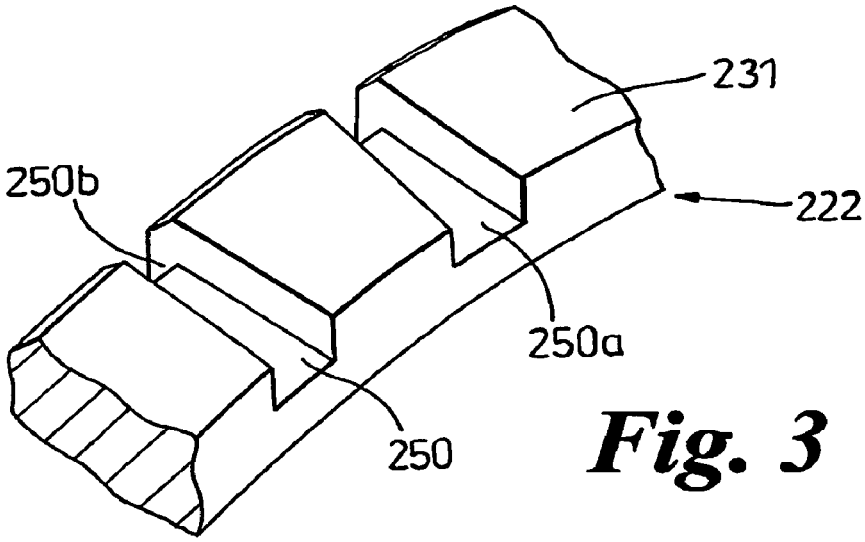
FIG. 3 is a partial perspective view of a part of an anode according to a third embodiment of the invention.
Figure 4:
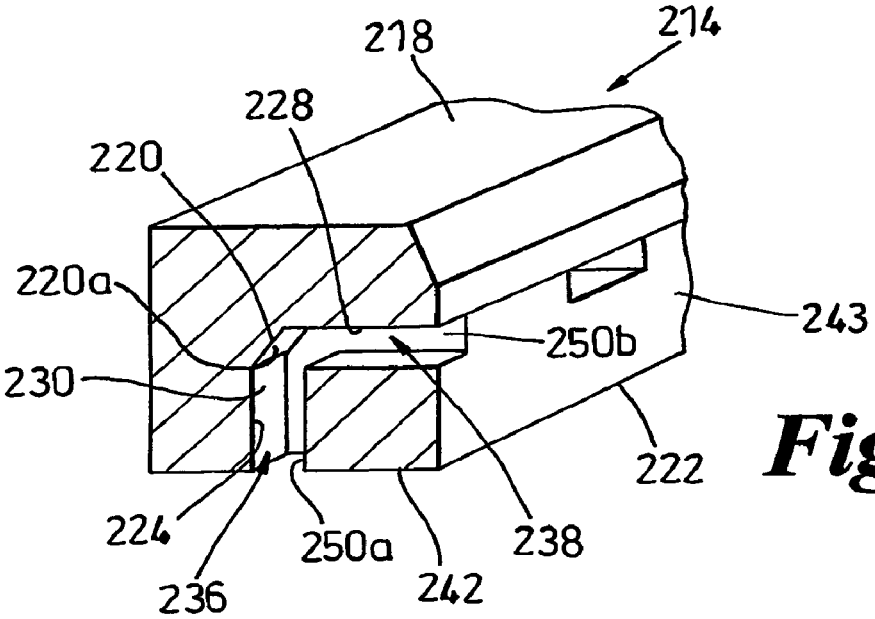
FIG. 4 is a partial perspective view of the anode of FIG. 4.

Referring to FIGS. 3 and 4, the anode of a second embodiment of the invention is similar to the first embodiment, and corresponding parts are indicated by the same reference numeral increased by 200. In this second embodiment, the main part 218 of the anode is shaped in a similar manner to that of the first embodiment, having an inner side 224 made up of a target surface 220, and an X-ray collimating surface 228 and an electron aperture surface 230, in this case angled at about 11° to the collimating surface 228. The collimating part 222 of the anode again has a series of parallel channels 250 formed in it, each including an electron aperture part 250*a*, and an X-ray collimating part 250*b* such that, when the two parts 218, 222 of the anode are placed in contact with each other, they define respective electron apertures 236 and X-ray apertures 238. The two X-ray collimating surfaces 228, 232 are angled at about 90° to the electron aperture surfaces 230, 234 but are angled slightly to each other so that they define between them the X-ray aperture 238 which is at about 90° to the electron aperture 236.

As with the embodiment of FIG. 2, the embodiment of FIGS. 3 and 4 shows that the collimating apertures 238 broaden out in the horizontal direction, but are of substantially constant height. This produces a fan-shaped beam of X-rays suitable for use in tomographic imaging. However it will be appreciated that the beams could be made substantially parallel, or spreading out in both horizontal and vertical directions, depending on the needs of the particular application.

Figure 5:
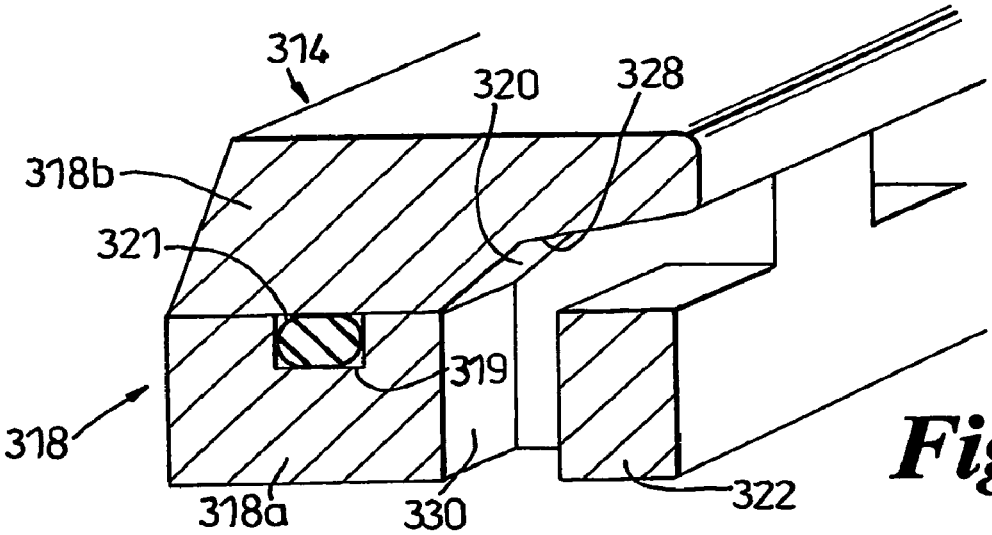
FIG. 5 is a partial perspective view of an anode according to a fourth embodiment of the invention.

Referring to FIG. 5, in a third embodiment of the invention the anode includes a main part 318 and a collimating part 322 similar in overall shape to those of the first embodiment. Other parts corresponding to those in FIG. 2 are indicated by the same reference numeral increased by 300. In this embodiment the main part 318 is split into two sections 318*a*, 318*b*, one 318*a* which includes the electron aperture surface 330, and the other of which includes the target region 320 and the X-ray collimating surface 328. One of the sections 318*a* has a channel 319 formed along it parallel to the target region 320, i.e. perpendicular to the direction of the incident electron beam and the direction of the X-ray beam. This channel 319 is closed by the other of the sections 318*b* and has a coolant conduit in the form of a ductile annealed copper pipe 321 inside it which is shaped so as to be in close thermal contact with the two sections 318*a*, 318*b* of the anode main part 318. The pipe 321 forms part of a coolant circuit such that it can have a coolant fluid, such as a transformer oil or fluorocarbon, circulated through it to cool the anode 314. It will be appreciated that similar cooling could be provided in the collimating part 322 of the anode if required.

The invention claimed is:

1. An anode for an X-ray tube having a plurality of channels wherein each channel comprises:

an electron part, wherein said electron part subjects electrons traveling through said electron part to substantially no electrical field;

an X-ray collimating part, wherein said X-ray collimating part has a varying width;

an aperture, formed by said X-ray collimating part, through which X-rays are emitted after passing through said X-ray collimating part; and a target positioned between said electron part and said X-ray collimating part, wherein said target is positioned at an angle relative to said electron part and said X-ray collimating part and wherein said electron part is positioned at an angle relative to said X-ray collimating part.

2. The anode of claim 1 wherein each channel is formed by joining a first part and a second part.

3. The anode of claim 1 wherein said first part and second part are first separately formed and then joined.

4. The anode of claim 1 wherein the first part and second part are held at a substantially equal electrical potential.

5. The anode of claim 1 comprising at least two channels, wherein the apertures of said two channels emit X-ray beams in two different directions.

6. The anode of claim 1 wherein the electron part of each channel comprises a surface that is substantially flat and perpendicular to the direction of travel of electrons.

7. The anode of claim 1 wherein the electron part is positioned at an angle of about 90 degrees relative to the X-ray collimating part.

8. The anode of claim 1 wherein the electron part defines an electron beam direction in which an electron beam can travel to reach the target, and wherein the target has a target surface impacted by electrons in the electron beam, and wherein the electron beam direction is at an angle of 10 degrees or less to the target surface.

9. The anode of claim 8 wherein the electron beam direction is at an angle of 5 degrees or less relative to the target surface.

10. The anode of claim 1 wherein the anode further comprises cooling means for cooling the anode.

11. The anode of claim 10 wherein the cooling means comprises a coolant conduit for carrying coolant through the anode.

12. The anode of claim 11 wherein the coolant conduit is provided in at least one of said channels.

13. An X-ray tube comprising the anode of anyone of claims 1-12.

* * * * *